United States Patent [19]

Hargrove

[11] 4,307,333

[45] Dec. 22, 1981

[54] TWO WAY REGULATING CIRCUIT

[75] Inventor: Arthur K. Hargrove, Irvine, Calif.

[73] Assignee: Sperry Corporation, New York, N.Y.

[21] Appl. No.: 173,284

[22] Filed: Jul. 29, 1980

[51] Int. Cl.[3] ..... G05F 3/08

[52] U.S. Cl. ..... 323/313; 323/349; 307/297; 307/304

[58] Field of Search ..... 323/311-315, 323/349, 350, 351; 307/296 R, 297, 304; 330/296, 297; 357/40, 41

[56] References Cited

U.S. PATENT DOCUMENTS

| | | | |
|---|---|---|---|
| 4,032,838 | 6/1977 | Minami et al. | 323/349 |
| 4,092,548 | 5/1978 | Beilstein et al. | 307/304 X |
| 4,100,437 | 7/1978 | Hoff, Jr. | 307/297 |
| 4,165,478 | 8/1979 | Butler et al. | 307/304 X |
| 4,208,595 | 6/1980 | Gladstein et al. | 307/304 X |
| 4,229,667 | 10/1980 | Heimbigner et al. | 307/304 X |

OTHER PUBLICATIONS

B. H. Jensen, "Substrate Voltage Generating Circuit", I.B.M. Technical Disclosure Bulletin, vol. 21, No. 2, Jul. 1978.

*Primary Examiner*—William M. Shoop
*Assistant Examiner*—Peter S. Wong
*Attorney, Agent, or Firm*—G. Donald Weber; Eugene T. Battjer; William E. Cleaver

[57] ABSTRACT

A circuit for controlling the charge and the voltage of a substrate for use with integrated circuit devices.

11 Claims, 3 Drawing Figures

TWO WAY REGULATING CIRCUIT

BACKGROUND

1. Field of the Invention

This invention relates to MOS integrated circuits of the type having a substrate bias, in general, and to a circuit for regulating the substrate bias voltage in a MOS/LSI device, in particular.

2. Prior Art

With the advent of MOS/LSI devices, many advances have been achieved in the electronics industry. These advances are permitted because the MOS/LSI circuits permit many more functions and operations to be performed by a very small electronic network. The electronic network or circuit is, typically, provided by establishing a large number of semiconductor circuits on a single substrate. This is highly advantageous over the now outdated approach wherein discrete components were connected together.

However, other problems have been observed and, for the most part, overcome. For example, it was necessary to perfect the techniques of making the circuitry. It was also necessary to eliminate any cross-talk between channels or circuits on a single substrate. Likewise, it was necessary to overcome problems of heat sinking or other thermal control in the substrate. As noted, for the most part, these problems have been overcome.

However, another problem which is continuously being examined and evaluated is the problem of biasing the common substrate. That is, the substrate bias (i.e., voltage or charge) can have a very pronounced effect on the operation of the circuits on the substrate. For example, the substrate bias can be used to control the threshold voltage on either N-channel or P-channel type devices. As the state of the art advances substrate bias plays an increasingly important role in controlling the operation of other circuits on the substrate and in reducing some parasitic effects, e.g., diode capacitance. Moreover, the substrate bias can vary, inter alia, as a function of the supply voltage, as a function of noise coupled from other circuits, or as a function of the temperature of the substrate. Consequently, these variations in substrate bias can cause variations in the operation of the MOS/LSI device. Consequently, it is highly desirable to control this substrate bias.

However, it is also highly desirable to reduce the number of supply sources which are required for the MOS/LSI device. That is, it is highly undesirable to be required to produce (or supply) a supply voltage which is directed only to the substrate.

In the past, substrate bias circuits have been designed which can be placed right on the substrate of the MOS/LSI device along with other circuitry. However, the devices which are known in the art are generally of a single polarity control. That is, the known devices can control the substrate bias only by preventing it from exceeding a certain value in a certain direction. If the substrate bias exceeds a value in the opposite direction or sense, then the known control devices have little or no effect. However, it is evident that this type of two-way or dual control is highly desirable.

PRIOR ART STATEMENT

The most pertinent prior art which has been discovered in a search is listed herewith.

U.S. Pat. No. 4,165,478——Butler which discloses a reference voltage source which is insensitive to temperature and supply voltage.

U.S. Pat. No. 4,100,437—Hoff which discloses a MOS reference voltage circuit providing a stable reference voltage relative to both temperature and supply variations.

Other U.S. patents of lesser pertinence are listed herewith:

U.S. Pat. No. 3,808,468
U.S. Pat. No. 3,898,474
U.S. Pat. No. 4,004,158
U.S. Pat. No. 4,004,164
U.S. Pat. No. 4,115,710
U.S. Pat. No. 4,163,161

SUMMARY OF THE INVENTION

The instant invention provides a circuit which can be used directly on the substrate of a MOS/LSI device. The control circuit is adapted to be driven by a drive source which is already available on the MOS/LSI chip. The circuit is produced during the fabrication of the MOS/LSI device and is in place when the MOS/-LSI device is completed.

The circuit operates through cross-coupled networks to control the substrate bias in terms of either voltage or charge. The drive circuit on the chip is arranged to control the operation of the regulating network so that charge can be alternatively supplied to or obtained from the substrate network depending upon the substrate bias. The circuit is self-regulating and provides a highly accurate means for controlling the substrate bias as related to a MOS/LSI chip or device.

DESCRIPTION OF A PREFERRED EMBODIMENT

Figure 1:
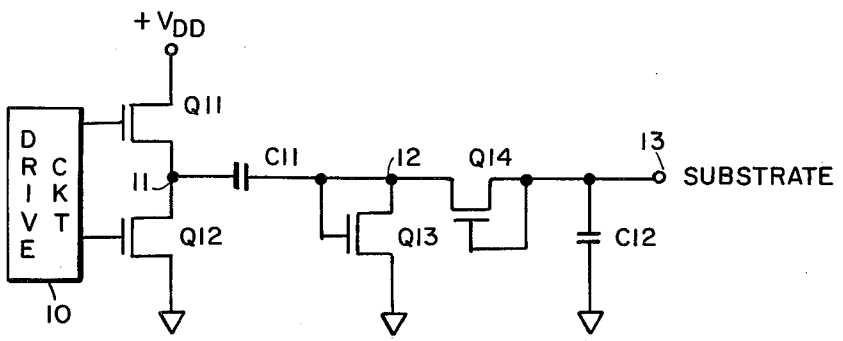
FIG. 1 PRIOR ART
FIG. 1 is a schematic diagram of a substrate bias network known in the prior art.

Referring briefly to FIG. 1, there is shown a schematic diagram of a prior art network which is used to control the substrate bias in a MOS/LSI chip. In this prior art circuit, driver 10 is connected to the gate electrodes of a pair of series connected devices Q11 and Q12. In a typical example, the devices Q11 and Q12 can be N or P-channel MOSFETS which have the source-drain paths connected in series between the source voltage $V_{DD}$ and ground. In addition, MOSFET's Q11 and Q12 are generally of the same type as the other circuits fabricated on the same substrate. However, this is not a requirement as the circuit could be fabricated on a Complementary Metal Oxide Semiconductor (e.g., CMOS) substrate using complementary (e.g., P and N-channel) devices.

The common junction 11 between devices Q11 and Q12 is connected to one terminal of capacitor C11. The other terminal of capacitor of C11 is connected to node 12. Also connected to node 12 is one side of the source-drain path of device Q13 the other side of which is returned to ground. The gate electrode of device Q13 is also connected to node 12. Node 12 is further connected to one side of the source-drain path of another device Q14 which is connected as a diode in that the gate electrode is connected to the other (e.g., drain) electrode of device Q14. The gate and drain electrodes of device 14 are also connected to node 13 which is connected to the substrate of the MOS/LSI device (or chip) in question and, as well, is connected via capacitor C12 to ground.

In operation, the drive source 10 causes transistor Q11 to be rendered as a source of current from $V_{DD}$ (i.e., highly conductive) while transistor Q12 is rendered essentially nonconductive. Thus, node 11 is driven to approximately $+V_{DD}$ which thereby essentially causes capacitor C11 to charge through transistor Q13. Thus, node 12 tends to be effectively clamped at the voltage $+V_T$ (the threshold voltage across transistor Q13). The voltage level $V_T$ is, thus, applied to transistor Q14 which is nonconductive in this direction because of its enhancement threshold and gate to source connection.

However, when drive source 10 switches polarity, transistor Q11 is turned off and transistor Q12 is turned on. At this point, node 11 is effectively clamped to ground through transistor Q12. Thus, node 12 tends to discharge below ground potential to approximately $-(V_{DD}-V_T)$. However, transistor Q14 turns on at this point and conducts current from the substrate node 13. Thus, the substrate voltage is pushed below ground by an amount dependent upon C12, C11 and the charge on C11. Transistor Q14, however, only conducts when the voltage on node 13 is less negative than the voltage on capacitor C11 in this state. As a consequence, the substrate bias at node 13 can only be controlled in one direction or polarity. Therefore, any problems or shortcomings such as those described previously, and which occur because of substrate bias, can only be partially cured or overcome by the prior art circuit shown in FIG. 1.

Figure 2:
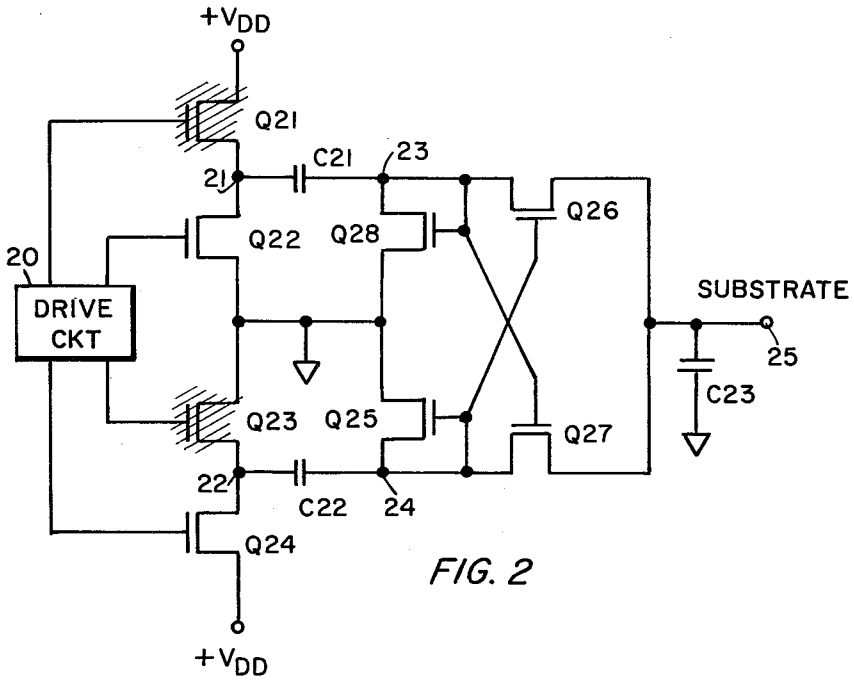
FIG. 2 is a schematic diagram of the circuit of the instant invention.

Referring now to FIG. 2, there is shown a schematic diagram of the circuit which forms the instant invention. In this circuit, a drive circuit 20 is provided. Drive circuit 20 is any suitable type of drive which is normally found on the MOS/LSI chip. It may be a clock signal, an oscillator driven separately on the chip, or the like. A first pair of transistors Q21 and Q22 have the source-drain networks thereof connected in series between the supply voltage $+V_{DD}$ and ground. A second pair of transistors Q23 and Q24 have the source-drain networks thereof connected in series between the supply source $+V_{DD}$ and ground. The gate electrodes of each of these transistors is connected to the drive circuit 20. As will be seen, these transistors can be arranged so that each pair (i.e., transistor pair Q21 and Q22 or transistor pair Q23 and Q24) can be comprised of one P-type device and one N-type device which are driven by a single pulse from the drive 20. Alternatively, all of the devices can be of the same type with opposite polarity signals applied to the base or gate electrodes thereof by drive circuit 20. Furthermore, transistors Q21 through Q24 need not be of any specific combination of enhancement and/or depletion threshold devices as long as the appropriate ratios of device sizes are consistent with the thresholds and drive circuit.

The common junction 21 between transistors Q21 and Q22 is connected to one terminal of capacitor C21. Likewise, common node 22 of transistors Q23 and Q24 is connected to one side of capacitor C22. The other side of capacitor C21 is connected to node 23 while the opposite side of capacitor C22 is connected to node 24.

Transistor Q28 has the source-drain path thereof connected from node 23 to ground while the source-drain path of transistor Q25 is connected from node 24 to ground. The gate electrodes of transistors Q28 and Q25 are connected to nodes 23 and 24, respectively. In addition, the base electrode of transistor Q28 is connected to the gate electrode of transistor Q27. Likewise, the gate electrode of transistor Q25 is connected to the gate electrode of transistor Q26. The source-drain paths of transistors Q26 and Q27 are connected together at node 25 and to the respective nodes 23 and 24 as shown. Capacitor C23 is also connected between node 25 and ground.

Figure 3:
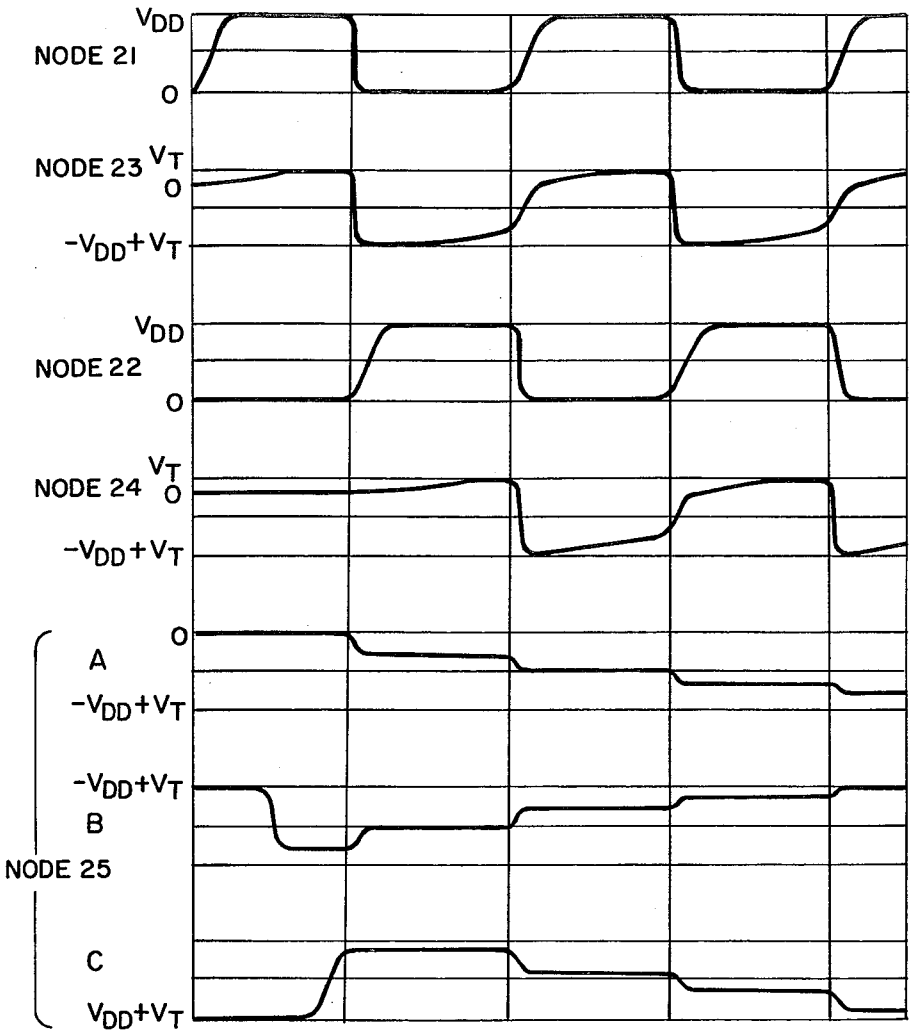
FIG. 3 is a graphic representation of waveforms in the circuit shown in FIG. 2.

In operation, reference is made concurrently to FIGS. 2 and 3. Thus, drive circuit 20 provides pulses or signals to transistors Q21, Q22, Q23 and Q24. As noted, these transistors can be of the complementary type or they can all be of the same type. However, whether the devices are complementary or the drive signals are complementary, the circuit is arranged so that transistors Q21 and Q23 are concurrently conductive while transistors Q22 and Q24 are concurrently conductive. In addition, when transistors Q21 and Q23 are conductive transistors Q22 and Q24 are nonconductive and vice versa. As noted, this can be accomplished by applying a control signal of one polarity to the gates of complementary devices or by applying control signals of opposite polarity to the gate electrodes of the respective devices.

For discussion purposes, it is assumed that when the control signals are supplied by driver 20 transistor Q21 is turned on and transistor Q22 is turned off. Meanwhile transistor Q24 is turned off and transistor Q23 is turned on. Assuming an initial condition with essentially zero charge or voltage at the substrate at node 25, when transistor Q21 is turned on, node 21 rapidly rises toward $+V_{DD}$ and thereby charges capacitor C21 through transistor Q28. The voltage at node 23 tends to follow until it reaches approximately $+V_T$ (i.e., the threshold voltage drop across transistor Q28). Therefore, the voltage across capacitor C21 is $V_C=V_{DD}-V_T$.

At the same time, as noted above, transistor Q23 is turned on and transistor Q24 is turned off. Consequently, the voltage at node 22 is approximately at ground as is the potential at node 24. Consequently, transistor Q26 is also turned off as a result of the assumption that the potential at the substrate is approximately zero. At this time, transistor Q27 may be nominally turned on but this conduction state is of no significant consequence at this juncture.

With the reversal of the drive signals supplied by drive circuit 20, the conduction of the transistors is reversed. Thus, transistor Q24 becomes conductive and transistor Q23 is turned off so that node 22 now shifts to approximately $+V_{DD}$ and node 24 shifts to approximately $+V_T$ as capacitor C22 charged. Consequently, the voltage drop across capacitor C22 is $$V_C=V_{DD}-V_T.$$

Concurrently, transistor Q22 is turned on and transistor Q21 is turned off wherein the potential at node 21 drops to approximately ground. This change in potential is reflected at node 23 where the potential is now $V=-(V_{DD}-V_T)$. This negative potential at node 23 causes transistor Q27 to be turned off. However, the relatively positive potential at node 24 (approximately $V_T$) causes transistor Q26 to be turned on wherein the charge stored in capacitor C21 is transferred to node 25 and stored in the capacitance thereof represented by capacitor C23. Thus, the substrate voltage is determined by the charge redistribution from capacitor C21 to capacitor C23 and the charge initially on capacitor C21 of approximately $V_C = -(V_{DD} - V_T)$. Inasmuch as transistor Q26 is turned on during this state of the circuit, irrespective as to whether the substrate (i.e., node 25) is at ground potential or any voltage more negative than ground, then the transfer of charge between capacitors C21 and C23 can be in either direction. Thus, this circuit will either add or remove voltage from node 25 to compensate for changes in voltage at node 25.

Once again, the signals produced by drive circuit 20 reverse and the operation of the transistors reverses to the original condition. That is, transistors Q21 and Q23 are turned on while transistors Q22 and Q24 are turned off. As a result, the potential at node 21 shifts to approximately $+V_{DD}$ while the voltage at node 22 shifts to approximately ground. Consequently, the voltage at node 23 is approximately $+V_T$ while the voltage at node 24 is approximately $V = -(V_{DD} - V_T)$. With these potentials, transistor Q26 is turned off and transistor Q27 is turned on to "dump" the charge stored in capacitor C22 into the substrate. Thus, the voltage and charge in the substrate are a function of the ratio of the charges on capacitors C21, C22 and C23 respectively. This operation continues as the signals from drive circuit 20 change.

Referring specifically to the conditions at node 25 in FIG. 3, there are shown different operating responses. For example, at line A, there is shown the operation at startup, for example. That is, node 25 is initially at 0 and is gradually driven toward $-V_{DD} + V_T$ as the circuit operates.

At line B, there is shown the operation when node 25 is at the $-V_{DD} + V_T$ level and a more negative voltage is produced in the substrate for some reason. Here it is seen that the voltage at node 25 is gradually driven more positive, toward $-V_{DD} + V_T$ until the voltage level is reached.

Conversely, at line C, there is shown the situation wherein node 25 is at the $-V_{DD} + V_T$ level and a sudden positive voltage is applied to the substrate. In this case, node 25 is gradually driven in the negative direction (similar to line A) until the $-V_{DD} + V_T$ voltage level is reached. Clearly, the circuit operates to continually monitor and correct the voltage at node 25 irrespective of the change which is detected.

However, it must be understood that as the voltage on the substrate varies, the threshold voltage of the transistors Q28 and Q25 is also affected. Consequently, the voltage drop across the capacitors C21 and C22 will vary. That is, as the substrate voltage increases in a negative direction, the threshold voltage $V_T$ also increases wherein the voltage across the respective capacitors C21 and C22 decreases so that the charge transferred to the substrate also decreases. Thus, it is clear that as the substrate voltage becomes too high, the charge transferred thereto is reduced and the substrate voltage is thereby controlled and regulated. Inasmuch as the instant circuit controls the substrate voltage and the circuit is, in response, controlled by the substrate voltage, a feedback-type control arrangement is provided. Thus, it is possible for the circuit to compensate for any threshold voltage changes which are caused by temperature changes in the integrated circuit. Likewise, and leakage or charge coupling in the substrate during normal operation is compensated for. Moreover, any variation in $V_{DD}$ is compensated for by this circuit inasmuch as the capacitor charge on capacitors C21 and C22 is dependent on voltage $V_{DD}$.

Thus, there is shown and described a preferred embodiment of a circuit for regulating the substrate voltage in a MOS/LSI circuit. The circuit will also function in any integrated circuit environment. The circuit provides control of the substrate bias whether produced by temperature variations, leakage current, charge coupling, or supply voltage changes. All of these aspects of integrated circuit operation are compensated for by the circuit of the instant invention.

It must be understood that the circuit can work with N-type devices as described, P-type devices, or complementary-type devices. Modification can be made in the specific drive signals, in the drive circuit or other arrangements of the specific components and devices in the circuit. However, the basic concept as shown and described remains constant and forms the basis for this invention. Any modifications which fall within the purview of this description are intended to be included therein as well. It must be understood that the description is intended to be illustrative only and is not intended to be limitative. Rather, the scope of the application is limited only by the claims appended hereto.

Having thus described a preferred embodiment of the instant invention, what is claimed is:

1. A circuit for regulating the voltage at a substrate comprising, first and second semiconductor devices each having one end of the respective conduction paths thereof connected to said substrate, source means, first and second reactive means connected between said source means and the other end of the respective conduction paths of said first and second semiconductor devices and, third and fourth semiconductor devices having the conduction paths thereof connected in series between said other ends of said first and second semiconductor devices, the control electrodes of said first and fourth semiconductor devices connected together, the control electrodes of said second and third semiconductor devices connected together and cross-coupled relative to said first and fourth semiconductor devices.

2. The circuit recited in claim 1 wherein, said first and second reactive means comprise first and second capacitance means.

3. The circuit recited in claim 2 wherein, said semiconductor devices comprise field effect transistors formed in said substrate.

4. The circuit recited in claim 1 wherein, said first and second semiconductor devices are mutually exclusively conductive.

5. The circuit recited in claim 1 wherein, said source means supplies charge to said first and second reactive means alternately.

6. The circuit recited in claim 1 wherein, said source means supplies charge to said first and second reactive means alternately, and said first and second reactive means alternately supply charge to or receive charge from said substrate as a function of the charge in said substrate and the conduction of said first and second semiconductor devices.

7. The circuit recited in claim 1 wherein, the conduction of said first and second semiconductor devices is controlled by said third and fourth semiconductor devices.

8. The circuit recited in claim 1 wherein, said source means includes, signal supplying means, a first pair of semiconductor devices connected to receive signals from said signal supplying means, and a second pair of semiconductor devices connected to receive signals from said signal supplying means, said first and second pairs of semiconductor devices connected to selectively supply signals to said first and second reactive means, respectively.

9. The circuit recited in claim 8 including, voltage supplying means connected to each of said first and second pair of semiconductor devices.

10. The circuit recited in claim 9 wherein, each of said first and second pairs of semiconductor devices is connected so that only one of the semiconductor devices in each pair is mutually conductive in response to the signals from said signal supplying means.

11. The circuit recited in claim 8 wherein, said first pair of semiconductor devices comprises a pair of complementary conductivity devices, and said second pair of semiconductor devices comprises a pair of complementary conductivity devices.

* * * * *